US006681968B2

(12) United States Patent
Zwagerman

(10) Patent No.: US 6,681,968 B2
(45) Date of Patent: Jan. 27, 2004

(54) KAYAK PORTAGE HARNESS AND METHOD

(76) Inventor: Peter L. Zwagerman, 6331 S. College, Tempe, AZ (US) 85283

( * ) Notice: Subject to any disclaimer, the term of this patent is extended or adjusted under 35 U.S.C. 154(b) by 145 days.

(21) Appl. No.: 10/087,572

(22) Filed: Mar. 1, 2002

(65) Prior Publication Data

US 2003/0164391 A1 Sep. 4, 2003

(51) Int. Cl.[7] ..... A45F 4/02

(52) U.S. Cl. ..... 224/153; 224/584; 224/638; 224/643; 224/644; 224/651; 224/406; 114/347

(58) Field of Search ..... 224/576, 153, 224/584, 586, 627, 638, 643, 644, 651, 259, 261, 262, 406; 114/343, 347

(56) References Cited

U.S. PATENT DOCUMENTS

| | | | | | |
|---|---|---|---|---|---|
| 3,734,367 | A | | 5/1973 | Jackson | |
| 4,793,535 | A | * | 12/1988 | Johnson | 224/329 |
| 4,804,025 | A | | 2/1989 | Bear | |
| 5,095,722 | A | | 3/1992 | Chapmond et al. | |
| 5,284,280 | A | * | 2/1994 | Stonebraker et al. | 224/153 |
| 5,405,002 | A | | 4/1995 | Troia | |
| 5,634,576 | A | * | 6/1997 | Arbel | 224/153 |
| 5,647,522 | A | * | 7/1997 | Routh | 224/651 |
| 5,803,332 | A | * | 9/1998 | Thompson | 224/651 |
| 5,875,946 | A | | 3/1999 | Knudsen | |
| 5,961,014 | A | * | 10/1999 | Knerr | 224/259 |
| 5,988,098 | A | | 11/1999 | Hillhouse | |
| 6,019,263 | A | | 2/2000 | Palmer | |
| 6,315,177 | B1 | * | 11/2001 | Weatherall | 224/153 |
| 6,536,638 | B1 | * | 3/2003 | Gulmatico, III | 224/153 |

OTHER PUBLICATIONS

Salamanderpaddlegear.com unknown Figure over Travel.

* cited by examiner

*Primary Examiner*—Stephen K. Cronin
(74) *Attorney, Agent, or Firm*—John D. Lister

(57) ABSTRACT

A kayak portage harness includes: a draw cord in a hem of the harness that is used to secure the hem of the harness under the lip of a kayak cockpit coaming and a pair of opposed hooks that are also secured to the lip of the kayak cockpit coaming at the front and rear of the coaming. In addition, the harness may include a pair of hull straps that extend from the harness about the hull of the kayak and carry paddle clips for securing a paddle to a side of the kayak. The harness is secured to the back of the kayaker in a substantially vertical position for portaging by shoulder straps and an equipment gear bag of the harness fits down through the kayak cockpit into the hull.

14 Claims, 4 Drawing Sheets

FIG. 1
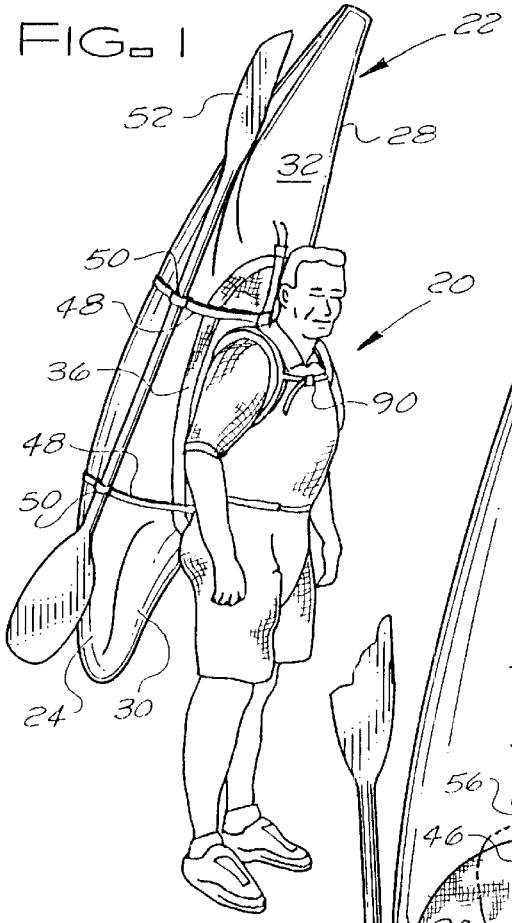
FIG. 2
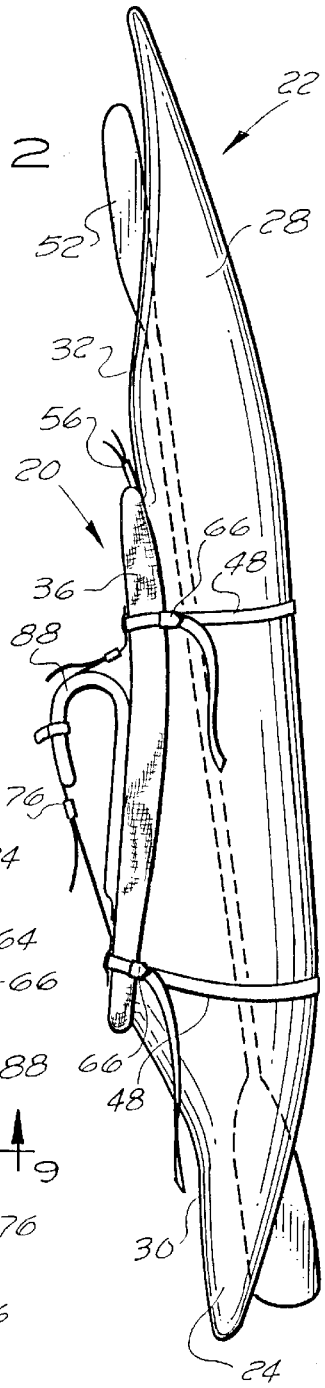
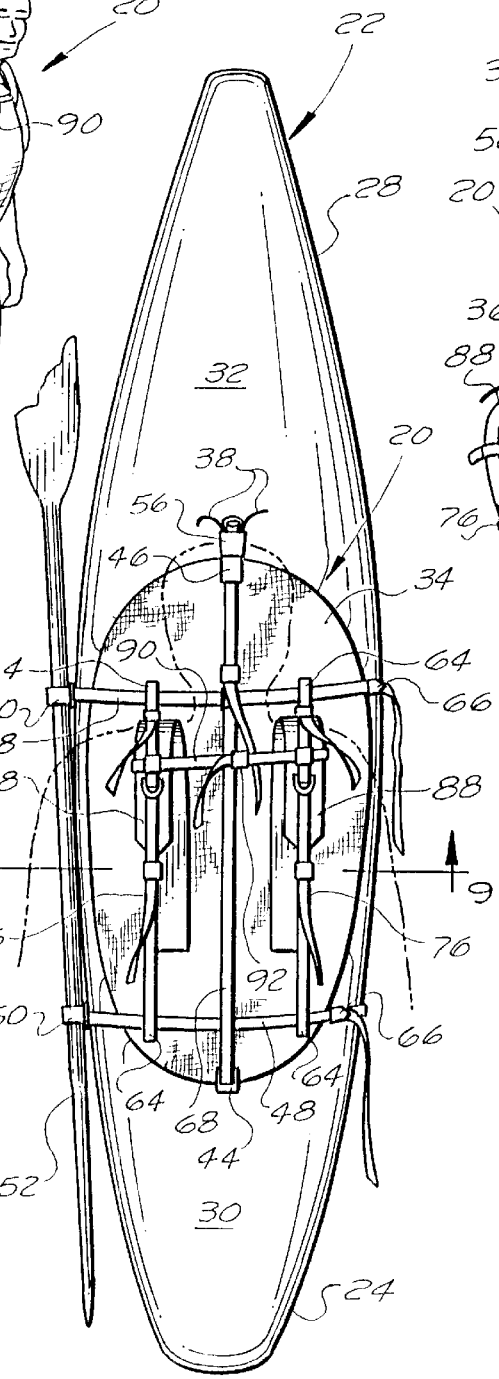
FIG. 3

FIG. 6
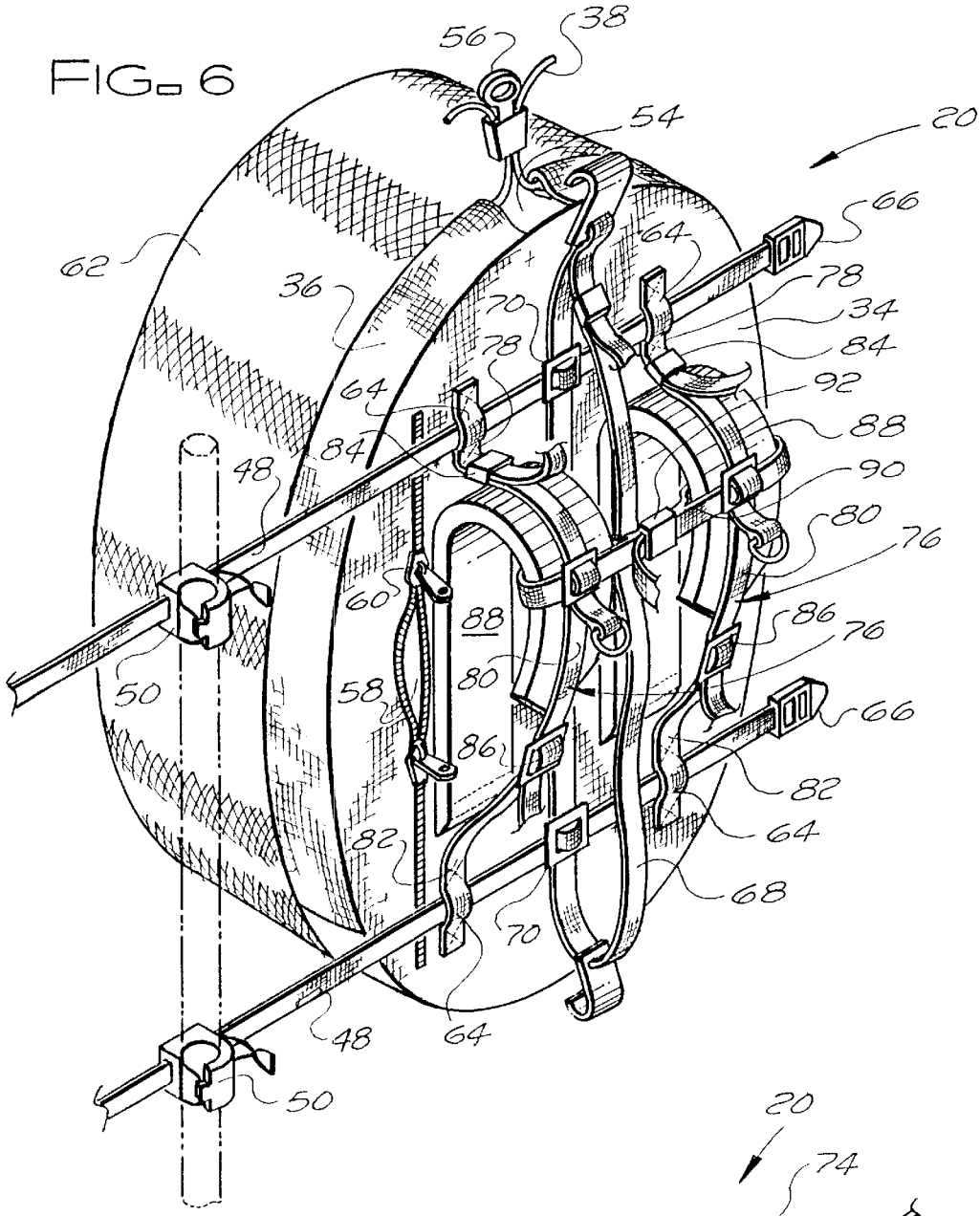
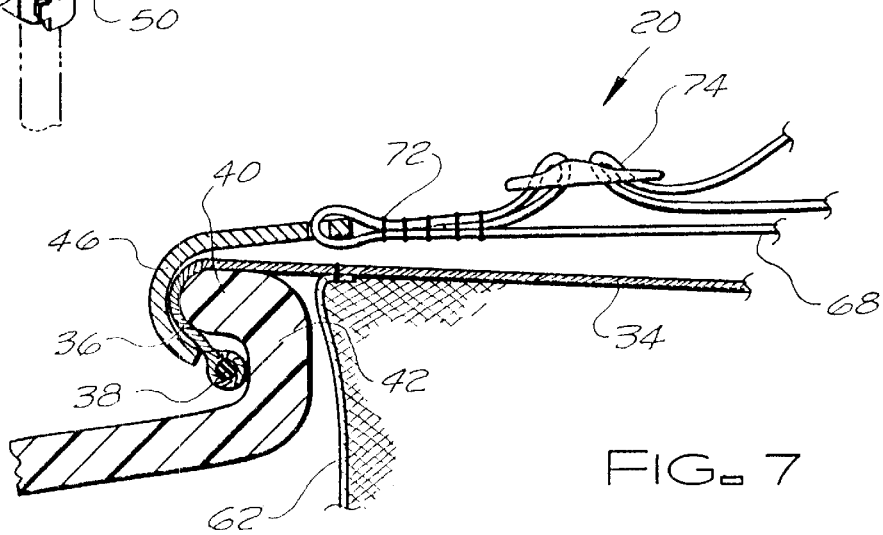
FIG. 7

FIG. 8
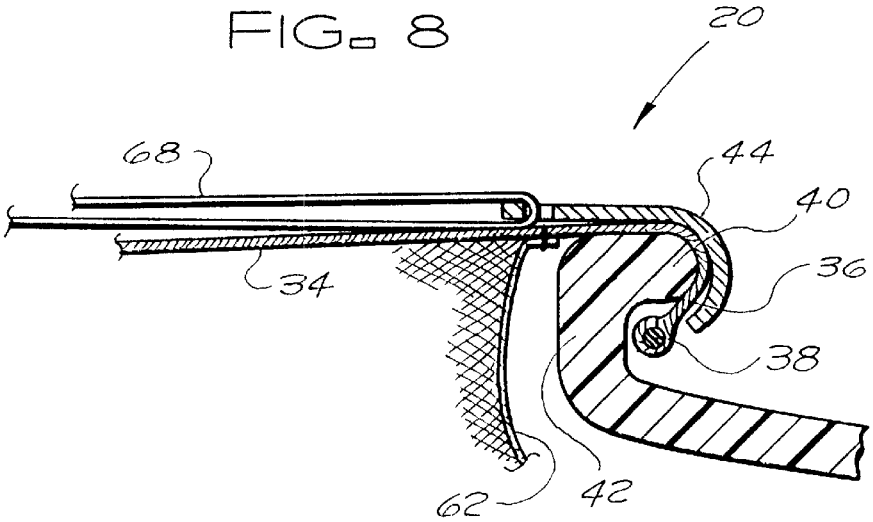
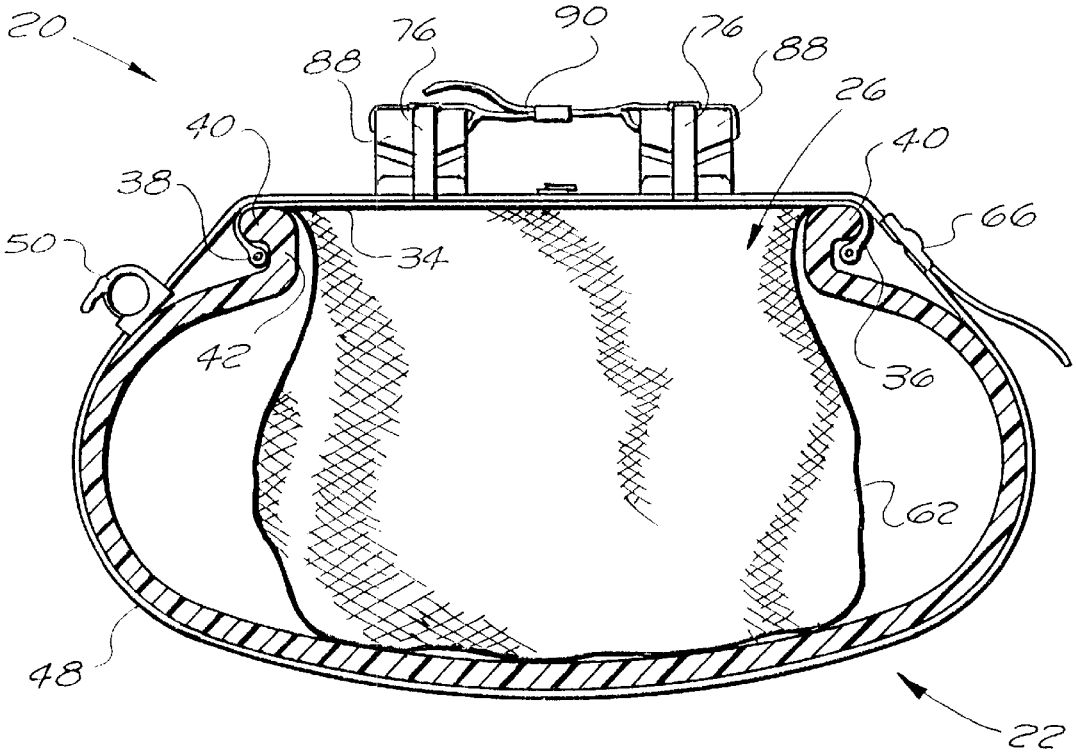
FIG. 9

KAYAK PORTAGE HARNESS AND METHOD

BACKGROUND OF THE INVENTION

The subject invention relates to a kayak portage harness and, in particular, to a kayak portage harness for carrying a kayak in a substantially vertical position on a kayaker's back that enables the kayaker to easily and safely support the weight of the kayak, that locates the kayak out of the kayaker's way and frees the kayaker's hands, that can be easily and quickly put on and taken off by the kayaker, that securely attaches the kayak to the kayaker's back, that can provide clips for carrying a kayak paddle on a side of the kayak, and that includes an equipment gear bag that fits down out of the way into the kayak cockpit.

When kayaking, it is frequently necessary to portage the kayak overland and into the backcountry. This presents numerous problems for the kayaker especially when he or she must portage the kayak and paddle by himself or herself and carry supplies. As shown by the following patents, attempts have been made to solve these and other associated problems.

U.S. Pat. Nos. 3,734,367; 5,875,946; and 6,019,263 all disclose portage systems for watercraft that utilize a harness. However, as shown, these portage systems are all designed to carry the canoe or kayak in a horizontal position over the head of the user and none of these portage systems include an equipment gear bag that fits down into the cockpit of a kayak.

U.S. Pat. Nos. 4,804,025; 5,095,722; and 5,405,002 disclose carrying harnesses for kayaks or surfboards that enable the kayak to be carried by hand and thus are impractical for long portages or difficult terrain.

U.S. Pat. No. 5,988,098 discloses a kayaking harness that supports the kayaker's back during a boating session.

Another portage device is the "BACK YAK" harness of Salamander Paddle Gear.com. As shown on the web page, the "BACK YAK" harness is worn with the bottom of the kayak against the person's back, includes a plurality of straps extending from the harness around the kayak and over the deck of the kayak, and includes shoulder straps and a waist belt for securing the harness to the kayaker.

SUMMARY OF THE INVENTION

The kayak portage harness of the subject invention solves the problems associated with portaging kayaks even over difficult terrain and is especially suited for portaging whitewater kayaks, such as but not limited to free-style, free-running and steep-creeking kayaks. The kayak portage harness of the subject invention includes: a cockpit cover, a hem in the cockpit cover with a draw cord that is used to secure the harness under the lip of a kayak cockpit coaming and a pair of opposed coaming hooks that are also used to secure the harness to the lip of the kayak cockpit coaming at the front and rear of the coaming. The draw cord and the coaming hooks are the primary means of securing the harness to a kayak for portage and the only means required to secure the harness to the kayak for portage. However, the harness also may include a pair of hull straps that extend from the harness about the hull of the kayak. These hull straps not only provide a secondary or backup means of securing the harness to a kayak, but also can be used to carry paddle clips for securing a paddle to a side of the kayak. The harness of the subject invention is secured by shoulder straps to the back of the kayaker to carry the kayak in a substantially vertical position for portaging and preferably, the cockpit cover includes a gear bag that is integral with the harness and fits down through the kayak cockpit into the hull of the kayak to store gear out of the way while portaging the kayak.

BRIEF DESCRIPTION OF THE DRAWINGS

FIG. 1 is a perspective view of a kayak being carried on the back of a kayaker with the kayak portage harness of the subject invention.

FIG. 2 is a side view of a kayak with the kayak portage harness of the subject invention mounted on the cockpit coaming.

FIG. 3 is a plan view of a kayak with the kayak portage harness of the subject invention mounted on the cockpit coaming.

FIG. 6 is a perspective view of the kayak portage harness of the subject invention.

FIG. 7 is an enlarged section of the circled portion 7 of FIG. 5.

FIG. 8 is an enlarged section of the circled portion 8 of FIG. 5.

FIG. 9 is a transverse cross section of a kayak with the kayak portage harness of the subject invention mounted on the cockpit coaming of the kayak taken substantially along lines 9—9 of FIG. 3.

DESCRIPTION OF THE PREFERRED EMBODIMENT

Figure 4:
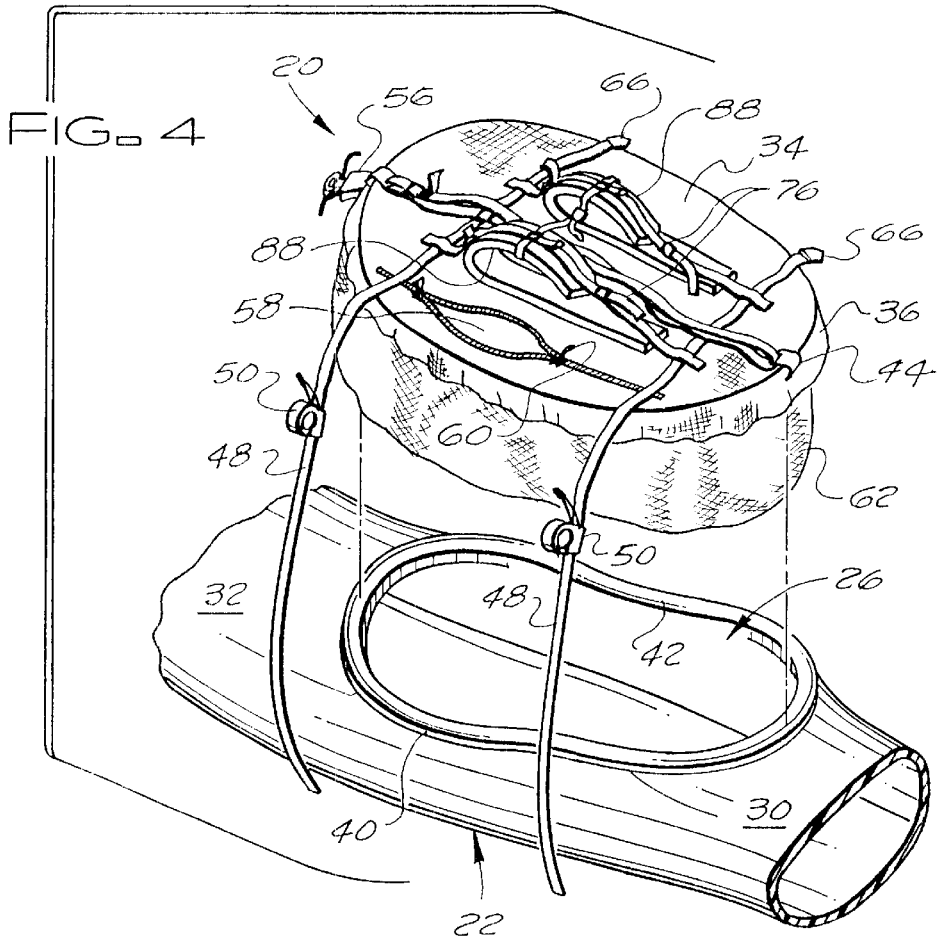
FIG. 4 is an exploded perspective view of a cockpit portion of a kayak and the kayak portage harness of the subject invention.
Figure 5:
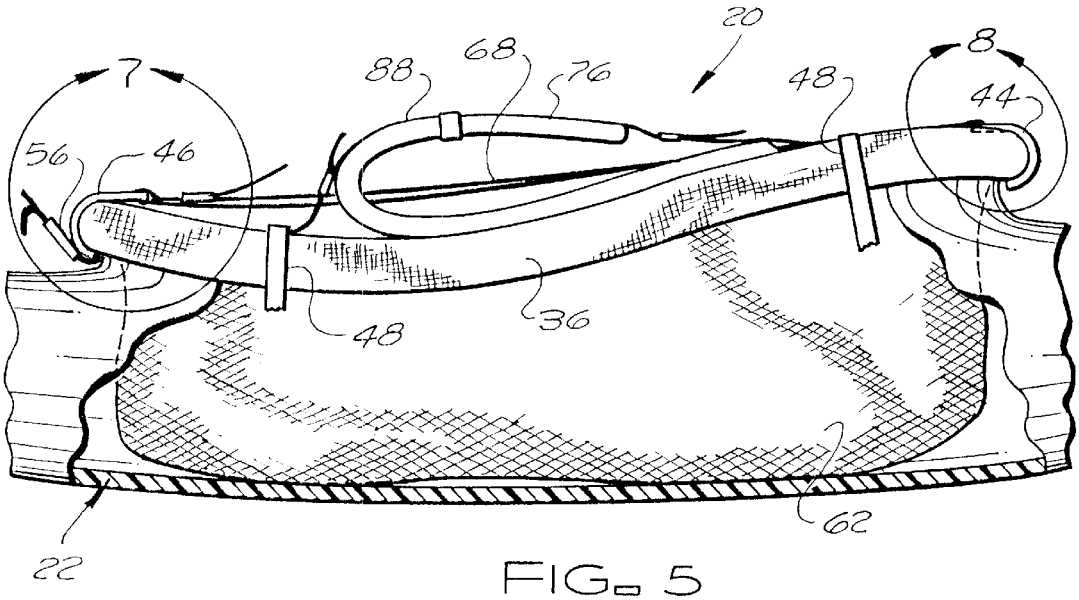
FIG. 5 is a side view of a cockpit portion of a kayak with a portion of the kayak broken away to show the gear bag within the cockpit.

As best shown in FIG. 1, the kayak portaging harness 20 of the subject invention is secured to the back of a kayaker to carry a kayak 22 in a substantially vertical position for portaging. As discussed above, the kayak portage harness 20 solves the problems associated with portaging a kayak even over difficult terrain and is especially suited for portaging whitewater kayaks, such as but not limited to free-style, free-running and steep-creeking kayaks. FIGS. 2 and 3, schematically illustrate a typical whitewater kayak 22. As shown, these whitewater kayaks have a bow portion 24 extending forward from a cockpit 26 of the kayak that is much shorter than a stem portion 28 that extends rearward from the kayak cockpit. In addition, the deck 30 of the bow portion 24 drops down away from the cockpit coaming to a greater degree than the deck 32 of the stem portion 28.

Since the kayak portage harness 20 is always secured directly to the coaming of the kayak cockpit 26 in a set location relative to the bow and stem of the kayak and the shoulder straps of the kayak portaging harness 20 secure the kayak in a set location against the back of the person portaging the kayak, by mounting the harness on the cockpit coaming so that the bow of the kayak points downward when the harness is worn, the drop away contour and relatively short length of the bow portion of the kayak can be used to the advantage of the kayaker when portaging a kayak. If the kayak portage harness 20 were secured to the kayak so that, when worn, the stem of the kayak pointed downward, the longer and less contoured deck 32 of the stem portion 28 of the kayak might interfere with the kayaker as his/her heels go back and up when walking and the stem might scrape or hit the ground or obstacles on the ground. With the kayak portage harness 20 mounted on the kayak so that, when worn, the bow of the kayak points downward, the shorter and more contoured deck 30 of the bow portion 24 is much less likely to interfere with the kayaker as he/she walks and the bow is much less likely to come in contact with the ground or obstacles on the ground.

The kayak portage harness 20 includes: a cockpit cover 34, a hem 36 in the cockpit cover with a draw cord 38 that is used to secure the harness under an outwardly projecting lip 40 of a kayak cockpit coaming 42 and a pair of opposed coaming hooks 44 and 46 that are also used to secure the harness to the lip 40 of the kayak cockpit coaming at the front and rear of the coaming respectively. The draw cord 38 and the coaming hooks 44 and 46 are the primary means of securing the kayak portage harness 20 to the kayak for portage and the only means required to secure the harness to the kayak for portage. However, the kayak portage harness 20 also may include a pair of hull straps 48 that extend from the harness about the hull of the kayak. These hull straps 48 not only provide a secondary or backup means of securing the harness to the kayak in the unlikely event of a failure of the primary means for securing the kayak portage harness 20 to kayak, but also can be used to carry paddle clips 50 for securing a paddle 52 to a side of the kayak when portaging the kayak.

The hem 36 of the cockpit cover 34 extends around the periphery of the cockpit cover so that the draw cord 38, when tightened, draws the hem 36 of the cockpit cover under the outwardly projecting lip 40 of the cockpit coaming 42. The cockpit cover 34 is typically made of a fabric marketed by Dupont Corporation under the trade designation "Cordura" and the draw cord 38 may be an elastic draw cord. The hem 36 has an opening 54 at the portion of the hem that fits over the rear portion of the cockpit coaming. The end portions of the draw cord 38 extend from within the hem 36 out through the opening 54 and pass through a conventional cord closure 56 that may be used to both tighten the draw cord 38 to secure the hem 36 under the outwardly projecting coaming lip 40 and loosen the draw cord 38 to remove the hem 36 from under the outwardly projecting coaming lip 40. A conventional cord closure that may be used for the cord closure 56, is a cord closure with cord retaining features to regulate cord travel through the closure marketed by ITW NEXUS of Des Plaines, Ill., under the trade designation "Progresso B-Lok 5A" part no. 303-0051.

Normally, the cockpit cover 34 fully encloses or covers the kayak cockpit when the kayak portage harness 20 is secured to the cockpit coaming. However, the cockpit cover 34 may have one or more openings therein, such as the opening 58 with its zipper closure 60, so that a person can gain access to the cockpit interior when the harness is mounted on the kayak cockpit or access to a gear bag 62 that can be an integral part of the kayak portage harness 20. When the gear bag 62 is included as an integral part of the harness, the edge portion of the open end of the gear bag is stitched or otherwise secured to an outer peripheral portion of an inside surface of the cockpit cover 34. Preferably, the gear bag 62 is made of a conventional mesh or netting material.

The cockpit cover 34 has a longitudinal centerline that extends from the front to the rear (fore and aft) of the cockpit cover and parallel to the longitudinal centerline of a kayak when the cockpit cover is mounted on the cockpit coaming of the kayak. The hull straps 48 are secured to an outside surface of cockpit cover 34 with one of the hull straps 48 secured to a forward portion of the cockpit cover and the other hull strap 48 secured to a rear portion of the cockpit cover. Preferably, the hull straps 48 pass through and are slidably received within loops 64 stitched or otherwise affixed to the outside surface of the cockpit cover 34. The hull straps 48 extend generally perpendicular to the longitudinal centerline of the cockpit cover and, when the cockpit cover 34 is mounted on the cockpit coaming of a kayak, perpendicular to the longitudinal centerline of the kayak. With this orientation, when the kayak portage harness 20 is mounted on the cockpit coaming of a kayak, the hull straps 48 can be wrapped about the outside bottom of the kayak hull to further secure the kayak portage harness 20 to a kayak. A conventional buckle 66 is secured one end of each of the hull straps 48. The buckle 66 receives the opposite end of the hull strap which passes through the buckle and is doubled back on itself so that the hull strap 48 can be tightened about the hull of a kayak and retained in place when securing the kayak portage harness 20 to a kayak or loosened when removing the kayak portage harness from a kayak. A conventional buckle that may be used for the buckles 66, is a buckle referred to as a "ladderloc" buckle with strap retaining features to regulate strap travel through the buckle. The buckle is marketed by ITW NEXUS of Des Plaines, Ill., under the trade designation "Superloc" part number 104-1100.

Preferably, the paddle clips 50 are slidably mounted on the hull straps 48. The paddle clips wrap about and releasably lock a paddle shaft to the hull straps to secure a paddle 52 to a side of the kayak for portaging. A conventional clip that may be used for the clips 50 is a buckle marketed by Duraflex of Farmingdale, N.Y., under the trade designation "Elasto-Lok Ice Axe Buckle" part no. 7398.

The coaming hooks 44 and 46 are mounted on a coaming hook strap 68 that extends in a loop from the forward end to the rear end of the kayak portage harness 20. The coaming hook strap 68 extends along the longitudinal centerline of the kayak portage harness 20 and is secured to the cockpit cover 34. A preferred means of securing the coaming hook strap 68 to the cockpit cover 34 is by attaching the coaming cockpit strap 68 to the hull straps 48 where the hull straps 48 cross the longitudinal centerline of the kayak portage harness, e.g. with buckles 70. Preferably, the forward coaming hook 44 is slidably mounted on the coaming hook strap 68 at the forward end of the kayak portage harness 20 and rear coaming hook 46 is secured to an extension 72 of the coaming strap. A conventional buckle 74 is secured to one end of the coaming hook strap adjacent the extension 72. The buckle 74 receives the opposite end of the coaming hook strap which passes through the buckle and is doubled back on itself so that the coaming hook strap 68 can be shortened in length to secure the coaming hooks 44 and 46 under coaming lip 40 at the forward and rear end portions of the cockpit coaming 42 and retained in place when securing the kayak portage harness 20 to the coaming of a kayak or loosened when removing the kayak portage harness from the coaming of a kayak. A conventional buckle that may be used for the buckles 74, is a buckle referred to as a "ladderloc" buckle with strap retaining features to regulate strap travel through the buckle. The buckle is marketed by ITW NEXUS of Des Plaines, Ill., under the trade designation "Superloc" part number 104-1100.

The kayak portage harness 20 has a pair of shoulder straps 76 for securing the cockpit cover 34 against the back of a wearer to carry a kayak attached to the kayak portage harness with the bow and stem of the kayak oriented generally vertically with respect to each other. The pair of shoulder straps 76 extend generally parallel to the coaming hook strap 68, are located on each side of the coaming hook strap 68 between the coaming hook strap and the side edges of the cockpit cover 34, and are secured to the rear and forward portions of the cockpit cover 34 (upper and lower portions of the cockpit cover when the kayak portage harness 20 is being worn). Preferably, the shoulder straps 76 are secured to the cockpit cover 34 by the hull strap loops 64 through which the hull straps 48 pass. Each shoulder strap 76 includes a rear segment 78, an intermediate segment 80 and a forward segment 82 (the upper, intermediate and lower segments of each shoulder strap when the kayak portage harness is being worn). The rear segment 78 of each shoulder strap 76 is formed by an extension of one of the hull strap loops 64 secured to the rear portion of the cockpit cover and has a conventional buckle 84 secured to one end. Each buckle 84 receives one end of the intermediate segment 80 of one of the shoulder straps 76 that passes through the buckle and is doubled back on itself so that the shoulder strap 76 can be shortened or lengthened and retained at a selected length to comfortably accommodate the shoulder of the wearer. A buckle 86 is secured to the other end of the intermediate segment 80 of the shoulder strap 76. The forward segment 82 of each shoulder strap 76 is formed by an extension of one of the hull strap loops 64 secured to the forward portion of the cockpit cover. The buckle 86 of each intermediate segment 80 receives one end of the forward segment 82 of the shoulder strap that passes through the buckle and is doubled back on itself so that the shoulder strap 76 can be further adjusted, i.e. shortened or lengthened, and retained at a selected length to comfortably accommodate the shoulder of the wearer. A conventional buckle that may be used for the buckles 84 and 86, is a buckle referred to as a "ladderloc" buckle with strap retaining features to regulate strap travel through the buckle. The buckle is marketed by ITW NEXUS of Des Plaines, Ill., under the trade designation "Superloc" part number 104-1100.

To further add to the comfort of the wearer of the kayak portage harness, back and shoulder pads 88 are provided for each of the shoulder straps 76. The back and shoulder pads 88 are each secured at one end to the cockpit cover adjacent the hull strap loops 64 at the forward portion of the cockpit cover 34. The back and shoulder pads 88 can be permanently secured to the cockpit cover at these locations, e.g. by stitching, or the back and shoulder pads 88 can be detachably secured by a Velcro or similar fastener. The back and shoulder pads 88 each extend from adjacent the hull strap loops 64 at the forward end of the cockpit cover 34 toward the rear portion of the cockpit cover. Adjacent but spaced somewhat forward of the hull strap loops 64 at the rear portion of the cockpit cover 34, each back and shoulder pad 88 curves outward and back toward the forward portion of the cockpit cover 34. The intermediate segments 80 of the shoulder straps 76 are secured, e.g. by stitching, to the outer surfaces of the portions of the back and shoulder pads 88 that extend back toward the forward portion of the cockpit cover 34.

A length adjustable chest strap 90 with a conventional quick release buckle 92 extends between and is secured at its outer ends to the shoulder straps 76. The chest strap 90 keeps the shoulder straps 76 in a desired location on the shoulders of the wearer during a portage and with the quick release buckle 92, permits the kayak portage harness 20 to be quickly and easily removed from the wearer if desired or required. While not required or preferred, the kayak portage harness 20 may also include a waist or hip belt with a quick release buckle (not shown) that is worn about the waist or hip of the wearer and secured to the forward portion of the cockpit cover 34.

Preferably, the kayak portage harness 20 is mounted on a kayak 22 as follows:

1) the hem 36 of the cockpit cover 34 is secured beneath the outwardly protruding lip 40 of the cockpit coaming 42 by tightening and retaining the draw cord 38 in a tightened state with the cord closure 56;

2) the coaming hooks 44 and 46 are placed over the outwardly protruding lip 40 of the cockpit coaming 42 at the forward and rear portions of the cockpit coaming and the coaming hook strap 68 is tightened and retained in a tightened state with the coaming strap buckle 74 to draw the coaming hooks 44 and 46 under and secure the coaming hooks to the lip 40 of the cockpit coaming 42 at the forward and rear portions of the cockpit coaming;

3) the hull straps 48, if used, may then be wrapped about the bottom of kayak hull, tightened and retained in a tightened state by the hull strap buckles 66;

4) a shaft of a paddle 52 may then be clamped within the paddle clips 50 on the hull straps 48 to extend along the side of the kayak;

5) if not previously adjusted to a comfortable fit, the shoulder straps 76 are adjusted to fit comfortably over the shoulder of the wearer, the harness is put on, and the chest strap 90 between the shoulder straps is secured to retain the shoulder straps in place for a comfortable fit during the portage and to keep the shoulder straps 76 from slipping off the shoulders of the wearer.

The forward portion of the hem may include a fabric that is tacky to help the hem cling to the coaming. In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A kayak portage harness comprising:

a kayak cockpit cover for covering a kayak cockpit and being detachably secured to a peripherally extending and outwardly projecting lip of a cockpit coaming; the cockpit cover having an outside surface, an inside surface, fore and aft edges, and side edges; the cockpit cover having a hem extending along the fore and aft edges and the side edges; the hem having a hem cord therein and the hem cord having means for tightening the hem cord and hence the hem about a cockpit coaming and beneath a peripherally extending and outwardly projecting lip of a cockpit coaming to attach the cockpit cover to a cockpit coaming and for loosing the hem cord and hence the hem to detach the cover from a cockpit coaming;

a coaming hook strap extending from the fore edge to the aft edge of the cockpit cover substantially along a centerline of the cockpit cover; the coaming hook strap being secured to the cockpit cover; the coaming hook strap having a coaming hook at each end for hooking beneath an outwardly projecting lip of a cockpit coaming at fore and aft portions of a cockpit coaming; a means for tightening the coaming hook strap to secure the coaming hooks beneath an outwardly projecting lip of a cockpit coaming and further attaching the cockpit cover to a cockpit coaming and for loosing the coaming hook strap to detach the coaming hooks and the cockpit cover from a cockpit coaming; and a pair of shoulder straps for securing the cockpit cover against the back of a wearer to carry a kayak attached to the cockpit cover with a bow and stem of the kayak oriented generally vertically with respect to each other; the pair of shoulder straps being secured to the cockpit cover, extending substantially parallel to the coaming hook strap, and being located on each side of the coaming hook strap between the coaming hook strap and the side edges of the cockpit cover.

2. The kayak portage harness according to claim 1, including:

an adjustable chest strap extending between and secured to the pair of shoulder straps.

3. The kayak portage harness according to claim 2, including:

a first and a second hull strap for further attaching the cockpit cover to a kayak; the first hull strap extending generally perpendicular to the hook strap, being secured to an aft portion of the cockpit cover, and having a length to extend about a hull of a kayak; a means for tightening the first hull strap about a kayak hull to further attach the cockpit cover to a kayak and for loosening the first hull strap to detach the first hull strap and the cockpit cover from a kayak; the second hull strap extending generally perpendicular to the hook strap, being secured to a fore portion of the cockpit cover, and having a length to extend about a hull of a kayak; and a means for tightening the second hull strap about a kayak hull to further attach the cockpit cover to a kayak and for loosening the second hull strap to detach the second hull strap and the cockpit cover from a kayak.

4. The kayak portage harness according to claim 3, including:

clip means on each of the hull straps for attaching a kayak paddle to the hull straps with the kayak paddle extending fore and aft along a side of a kayak to which the cockpit cover is attached.

5. The kayak portage harness according to claim 4, including:

a gear bag secured to the inside surface of the cockpit cover for extending into a kayak cockpit to which the cockpit cover is attached; and an opening with a zipper closure in the cockpit cover for access to the gear bag.

6. The kayak portage harness according to claim 1, including:

a first and a second hull strap for further attaching the cockpit cover to a kayak; the first hull strap extending generally perpendicular to the hook strap, being secured to an aft portion of the cockpit cover, and having a length to extend about a hull of a kayak; a means for tightening the first hull strap about a kayak hull to further attach the cockpit cover to a kayak and for loosening the first hull strap to detach the first hull strap and the cockpit cover from a kayak; the second hull strap extending generally perpendicular to the hook strap, being secured to a fore portion of the cockpit cover, and having a length to extend about a hull of a kayak; and a means for tightening the second hull strap about a kayak hull to further attach the cockpit cover to a kayak and for loosening the second hull strap to detach the second hull strap and the cockpit cover from a kayak.

7. The kayak portage harness according to claim 6, including:

clip means on each of the hull straps for attaching a kayak paddle to the hull straps with the kayak paddle extending fore and aft along a side of a kayak to which the cockpit cover is attached.

8. The kayak portage harness according to claim 7, including:

a gear bag secured to the inside surface of the cockpit cover for extending into a kayak cockpit to which the cockpit cover is attached; and an opening with a zipper closure in the cockpit cover for access to the gear bag.

9. The kayak portage harness according to claim 1, including:

a gear bag secured to the inside surface of the cockpit cover for extending into a kayak cockpit to which the cockpit cover is attached; and an opening with a zipper closure in the cockpit cover for access to the gear bag.

10. A method of portaging a kayak with a kayak portage harness comprising:

providing a cockpit cover having an outside surface, an inside surface, fore and aft edges and side edges; the cockpit cover having a hem extending along the fore and aft edges and the side edges of the cockpit cover; the hem having a hem cord therein and the hem cord having means for tightening the hem cord and hence the hem about a cockpit coaming and beneath a peripherally extending and outwardly projecting lip of a cockpit coaming to attach the cockpit cover to a cockpit coaming and for loosing the hem cord and hence the hem to detach the cover from a cockpit coaming; the cockpit cover having a coaming hook strap extending from the fore edge to the aft edge of the cockpit cover substantially along a centerline of the cockpit cover; the coaming hook strap being secured to the cockpit cover; the coaming hook strap having a coaming hook at each end for hooking beneath an outwardly projecting lip of a cockpit coaming at fore and aft portions of a cockpit coaming; a means for tightening the coaming hook strap to secure the coaming hooks beneath an outwardly projecting lip of a cockpit coaming and further attaching the cockpit cover to a cockpit coaming and for loosing the coaming hooks to detach the coaming hooks and the cockpit cover from a cockpit coaming; and the cockpit cover including a pair of shoulder straps for securing the cockpit cover against the back of a wearer to carry a kayak attached to the cockpit cover with a bow and stern of the kayak oriented generally vertically with respect to each other; the pair of shoulder straps being secured to the cockpit cover, extending substantially parallel to the coaming hook strap, and being located on each side of the coaming hook strap between the coaming hook strap and the side edges of the cockpit cover; and securing the kayak cockpit cover to a peripherally extending and outwardly projecting lip of a kayak cockpit coaming by placing the hem over the outwardly projecting lip and tightening the hem cord about the cockpit coaming and by placing the coaming hooks over the outwardly projecting lip at fore and aft portions of the cockpit coaming and tightening the coaming hooks so that when the wearer places the harness straps on with the cockpit cover against the back of the wearer a bow of the kayak will be facing downward and a stem of the kayak will be facing upward.

11. The method of portaging a kayak with a kayak portage harness according to claim 10, including:

tightening an adjustable chest strap extending between and secured to the pair of shoulder straps.

12. The method of portaging a kayak with a kayak portage harness according to claim 11, wherein:

the cockpit cover includes a first and a second hull strap for further attaching the cockpit cover to a kayak; the first hull strap extending generally perpendicular to the hook strap, being secured to an aft portion of the cockpit cover, and having a length to extend about a hull of a kayak; a means for tightening the first hull strap about a kayak hull to further attach the cockpit cover to a kayak and for loosening the first hull strap to detach the first hull strap and the cockpit cover from a kayak; the second hull strap extending generally perpendicular to the hook strap, being secured to a fore portion of the cockpit cover, and having a length to extend about a hull of a kayak; and a means for tightening the second hull strap about a kayak hull to further attach the cockpit cover to a kayak and for loosening the second hull strap to detach the hull strap and the cockpit cover from a kayak; and the first and second hull straps are passed about the hull and tightened to further attach the kayak to the cockpit cover.

13. The method of portaging a kayak with a kayak portage harness according to claim 12, wherein:

the hull straps include a clip means on each of the hull straps for attaching a kayak paddle to the hull straps with the kayak paddle extending fore and aft along a side of a kayak to which the cockpit cover is attached and a kayak paddle is clamped within the clip means.

14. The method of portaging a kayak with a kayak portage harness according to claim 10, including:

carrying gear in a gear bag, secured to the inside surface of the cockpit cover, that extends into the kayak cockpit.

* * * * *